US005203241A

United States Patent [19]

Mattis

[11] Patent Number: 5,203,241

[45] Date of Patent: Apr. 20, 1993

[54] FLEXIBLE LINK PLIERS

[76] Inventor: James F. Mattis, 44200 Galway Dr., Northville, Mich. 48167

[21] Appl. No.: 835,839

[22] Filed: Feb. 14, 1992

[51] Int. Cl.[5] ..... B25B 7/04

[52] U.S. Cl. ..... 81/424; 269/6; 29/268; 81/387; 81/392; 81/395; 81/419

[58] Field of Search ..... 81/177.1, 177.6–177.9, 81/177.2, 489, 300, 415, 427.5, 419, 421–424, 424.5, 426, 426.5, 385–390, 392–393, 395; 606/207, 208; 269/3, 6; 29/268

[56] References Cited

FOREIGN PATENT DOCUMENTS 0012825 of 1912 United Kingdom ..... 81/177.7

0593723 6/1947 United Kingdom ..... 81/424

*Primary Examiner*—D. S. Meislin

*Attorney, Agent, or Firm*—Harness, Dickey & Pierce

[57] ABSTRACT

A plier-like tool having links added between the jaws and the body of the pliers. The links not only extend the length of the jaw side of the pliers, but also pivot relative to each other and perpendicular to the opening and closing direction of the pliers. The screws in these links can be left untightened to permit the links to pivot allowing the jaws to gain access into restricted areas otherwise inaccessible. Even with the link-screws loose the gripping force is transferred through the links to the jaws enabling the user to still grip objects or even retrieve them by simply pulling the pliers back out and letting the links follow. An additional aspect to the flex-link pliers is that the link-screws can be tightened so the links maintain their position relative to each other so the user can create any shape pliers desired.

8 Claims, 1 Drawing Sheet

FLEXIBLE LINK PLIERS

BACKGROUND OF THE INVENTION

1. Field of the Invention

This invention relates to plier-like tools. More specifically, the present invention relates to pliers with pivoting links allowing the jaws to move or be selectively fixed in the perpendicular direction of the gripping force.

2. Prior Art

The frustration of trying to reach behind or around obstructions in order to grab onto wires, nuts and bolts or retrieve non-metallic items has been experienced by both beginning and master craftsmen alike. Having a tool that could snake into tight spots and still have the ability to grip or retrieve would save time and frustration. However, prior art solutions to this problem range from building custom pliers designed for a specific task to having sets of pliers with bends and/or long noses. Even this does not always solve the problem and often the final solution involves tearing larger entry holes and then repairing the damage after the task is completed.

Examples of custom pliers with various special jaws designed for a specific task are disclosed in U.S. Pat. Nos. 4,014,226 (Auto Repair), 3,894,451 (Water Pump Pliers), 3,872,747 (Wire Fabric Fence Clamps), 4,785,694 (Spring Clip Extractor), and 4,073,179 (Clip Removing Device). These tools all have the common liability of being designed for only one task in mind.

Adjustable pliers have been limited to addressing the grasping and locking of the desired object by varying the gap and the shape of the two jaws.

The West U.S. Pat. No. 4,944,204 shows adjustable jawed pliers which allow the gap width to be determined by having one jaw move away from the other in the direction of the gripping force. No allowance is made for external restrictions with respect to the handles being in the way.

The Tucker U.S. Pat. No. 4,044,413 has both adjustable gap width and locking jaws as well as jaw inserts which move together to allow parallel pressure. Here the jaws are fixed to the handles demanding easy accessibility to the part.

The Houdeshell U.S. Pat. No. 4,114,482 is a group of adaptors added to "relatively movable jaw" members. Again all of these adaptors are designed only to assist in gripping large or irregular items and neglect to allow for space restrictions in the work place.

The prior art tools are in general limited to the extent of adjustment of the jaw gap relative to each other or custom jaw designs for specific gripping/holding. No device is known, however, to let the jaws move perpendicular to the direction of the gripping force.

SUMMARY OF THE INVENTION

The principal object of this invention is to provide a tool which can reach into spaces or behind obstructions in order to grab or hold objects to be secured. This is achieved by having links added to the jaw side of the pliers. These links have screws which can be left loose to allow the links to move around obstructions, following contours, and still allow the user to use the pliers to grip. When the screws in the links are not tight, closing pressure can still be transferred to the jaws even while retrieving something from a restricted space. Tightening the link screws before using allows the user to maintain the links in any unique shape desired and hold that shape during usage. Since each link-screw is independent of each other, the links can be tightened or left loose in any combination desired.

DETAILED DESCRIPTION OF PREFERRED EMBODIMENT

Figure 1A:
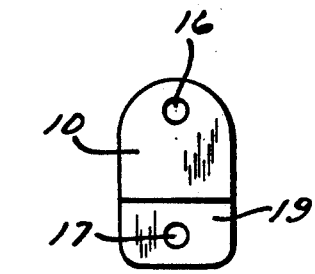
FIGS. 1*a*, 1*b*, and 1*c* show a top and side view of a link including the link-screw.
Figure 1B:
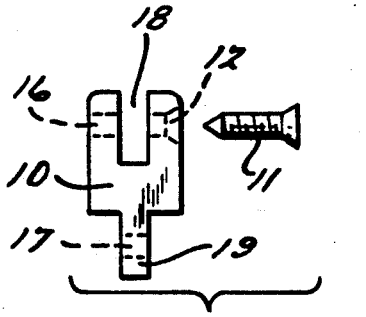
Figure 1C:
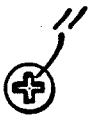

Referring now more specifically to FIG. 1 of the drawings, shown are the top and side views of one single link (10) with the link-screw (11) removed. All the links (10) are identical and interchangable allowing for the addition or removal of links (10). Each link (10) has three different holes; #12, #16, and #17. Hole #12 has a taper to it for the link-screw head while allowing the threads to slide through. Hole #16 is shown in phantom lines and is threaded for the link-screw. Once in, tightened down or not, the link-screw (11) will not protrude outside of the link (10). Tightening the link-screw will squeeze the groove (18) onto the tongue (19) of the next link or jaw. Hole #17 is a straight hole which allows a link-screw (11) to be the pivot point for that link (10).

Figure 2:
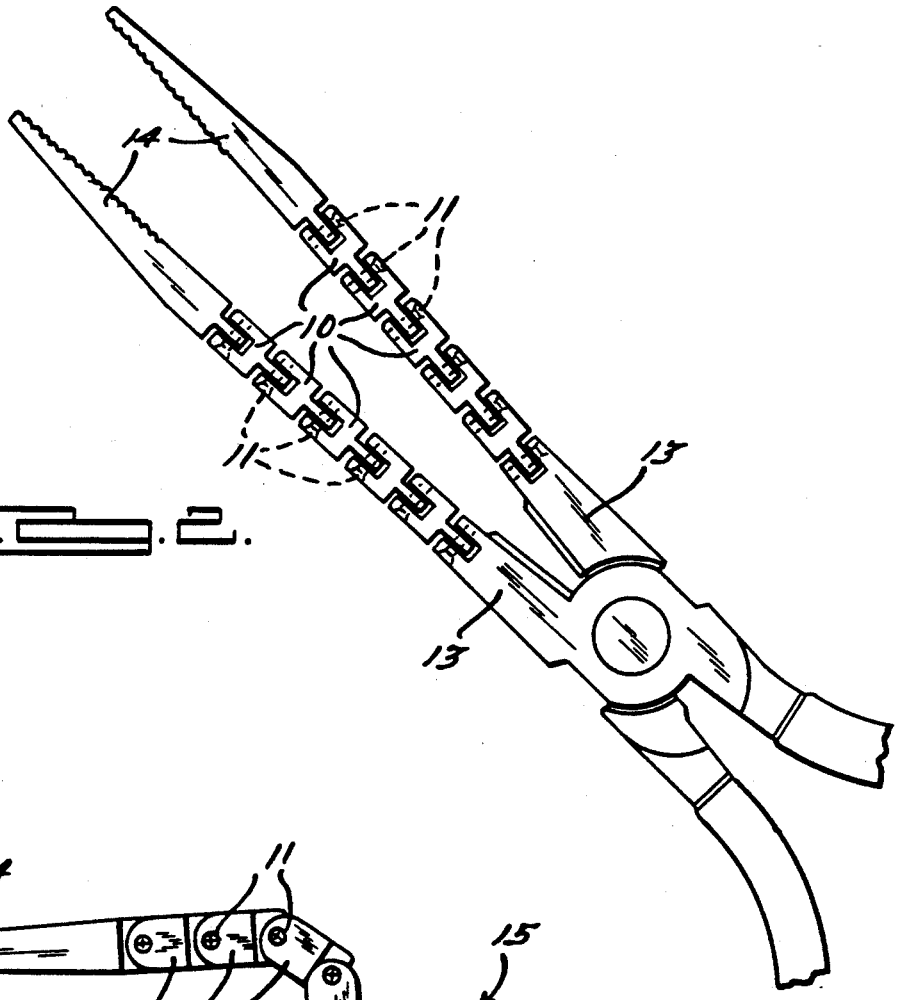
FIG. 2 is a side view of a pair of a pliers with five links in the jaws.

Refer now to FIG. 2, which is an overall drawing of a preferred embodiment of the invention. As shown, the links (10) are added in series between the jaws (14) and the body (13) of the pliers. Any number of links (10) can be used (five per side are shown). The links (10) do not pivot in this plane because of their tongue-in-groove design. This allows the pliers (15) to transfer any gripping pressure from the body (13) through the links (10) and to the jaws (14). The link-screws (11), shown in phantom lines, do not protrude out either side of the link (10).

Figure 3:
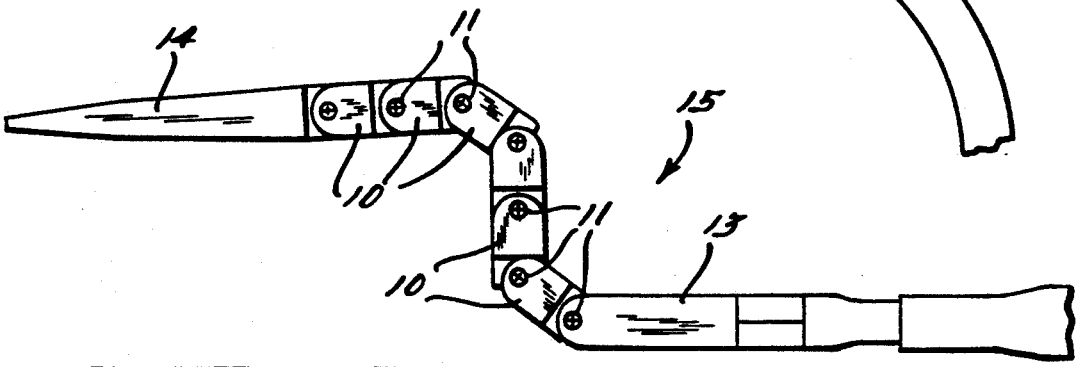
FIG. 3 illustrates a six-link plier viewed from the top. In this view it can be seen how the links allow the jaws to take on any shape necessary.

With attention now invited more specifically to FIG. 3 of the drawings, the top view of a six-link (10) plier shows the advantage the links (10) give the pliers. The links (10) pivot about the link-screw (11) a full 180 degrees. A series of links can be arranged into any configuration desired and then, by tightening the link-screws (11), the links (10) will maintain that unique shape. By not tightening the link-screws (11), the links (10) will pivot freely and independently to allow them to move or "snake" in and around things. Even while transferring the gripping force to the jaws (14), the links (10) can still pivot independently.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. Flexible link pliers comprising:

a plier body with a pair of elongated members extending therefrom, each including a jaw;

said plier body including a pair of handles connected through a pivot axis about which the handles pivot;

said elongated members including adjustable link means between said body and a respective said jaw for enabling said jaws to move freely and independently about axes orthogonal to said pivot axis.

2. The pliers of claim 1 wherein said link means includes links with link screws so that when the link-screws are un-tightened the pliers transfer the gripping force to the jaws while the links may pivot to enable the user to retrieve items from restricted places.

3. The pliers of claim 2 wherein the link screws in the links include means to lock the links into a desired shape.

4. The pliers of claim 2 wherein said links may be added or removed to lengthen or shorten the elongated members.

5. The pliers according to claim 1 wherein each elongated member link means are independently adjustable.

6. The pliers according to claim 1 wherein said link means includes means for locking said link means such that said elongated members may be positioned in any desired configuration.

7. The pliers according to claim 1 wherein said jaws include means for securing with said link means.

8. The pliers according to claim 1 wherein said jaws are elongated.

* * * * *

UNITED STATES PATENT AND TRADEMARK OFFICE

CERTIFICATE OF CORRECTION

PATENT NO. : 5,203,241

DATED : April 20, 1993

INVENTOR(S) : James F. Mattis

It is certified that error appears in the above-identified patent and that said Letters Patent is hereby corrected as shown below:

Column 3, line 4, claim 1, after "axis", insert –enabling the pliers to reach into or around things and apply a gripping force–.

Signed and Sealed this

Twenty-ninth Day of March, 1994

*Attest:*

Bruce Lehman

BRUCE LEHMAN

*Attesting Officer*

*Commissioner of Patents and Trademarks*